US008629344B2

(12) United States Patent
Yamanouchi

(10) Patent No.: US 8,629,344 B2
(45) Date of Patent: Jan. 14, 2014

(54) INPUT APPARATUS AND RECORDING MEDIUM WITH PROGRAM RECORDED THEREIN

(75) Inventor: Morio Yamanouchi, Fussa (JP)

(73) Assignee: Casio Computer Co., Ltd, Tokyo (JP)

( * ) Notice: Subject to any disclaimer, the term of this patent is extended or adjusted under 35 U.S.C. 154(b) by 172 days.

(21) Appl. No.: 13/251,335

(22) Filed: Oct. 3, 2011

(65) Prior Publication Data

US 2012/0103168 A1 May 3, 2012

(30) Foreign Application Priority Data

Oct. 28, 2010 (JP) ..... 2010-241790

(51) Int. Cl.
*G10H 3/00* (2006.01)

(52) U.S. Cl.
USPC ..... 84/615; 84/644; 84/653; 84/658; 84/670

(58) Field of Classification Search
USPC ..... 84/615, 653, 644, 658, 670
See application file for complete search history.

(56) References Cited

U.S. PATENT DOCUMENTS 5,157,213 A * 10/1992 Kashio et al. ..... 84/622
5,166,463 A * 11/1992 Weber ..... 84/600
5,170,002 A * 12/1992 Suzuki et al. ..... 84/600
5,177,311 A * 1/1993 Suzuki et al. ..... 84/600
5,192,823 A * 3/1993 Suzuki et al. ..... 84/600
5,290,964 A * 3/1994 Hiyoshi et al. ..... 84/600
5,585,584 A * 12/1996 Usa ..... 84/600
6,909,420 B1 * 6/2005 Nicolas et al. ..... 345/156
7,012,182 B2 * 3/2006 Nishitani et al. ..... 84/609
7,179,984 B2 * 2/2007 Nishitani et al. ..... 84/723
7,183,477 B2 * 2/2007 Nishitani et al. ..... 84/600
7,351,148 B1 * 4/2008 Rothschild et al. ..... 463/30
7,474,197 B2 * 1/2009 Choi et al. ..... 340/384.7
7,554,026 B2 * 6/2009 de Moraes ..... 84/615
7,674,969 B2 * 3/2010 Xu et al. ..... 84/615
7,781,666 B2 * 8/2010 Nishitani et al. ..... 84/723
7,943,843 B2 * 5/2011 Komatsu ..... 84/615
8,198,526 B2 * 6/2012 Izen et al. ..... 84/743

FOREIGN PATENT DOCUMENTS

JP 06-075571 3/1994

* cited by examiner

*Primary Examiner* — David S. Warren
(74) *Attorney, Agent, or Firm* — Turocy & Watson, LLP

(57) ABSTRACT

An input apparatus including: a first operation detecting section provided on a first operating section which detects acceleration and angular speed based on movement of the first operating section; a second operation detecting section provided on a second operating section which detects acceleration and angular speed based on movement of the second operating section; a judging section which judges whether or not the first and second operating sections have been held together, based on the accelerations and the angular speeds detected by the first and second operation detecting sections; a detecting section which detects a change operation based on the accelerations and the angular speeds detected by the first and second operation detecting sections, when the judging section judges that the first and second operating sections have been held together; and a changing section which changes a predetermined parameter in accordance with the change operation detected by the detecting section.

9 Claims, 8 Drawing Sheets

24 VARIATIONS OF ORIENTATION DIFFERENCE WHEN ( $\alpha$, $\beta$, $\gamma$ ) IS DIVIDED INTO 90 DEGREE ANGLES IN TWO HOUSINGS (LEFT-HAND SYSTEM)

INPUT APPARATUS AND RECORDING MEDIUM WITH PROGRAM RECORDED THEREIN

CROSS-REFERENCE TO RELATED APPLICATION

This application is based upon and claims the benefit of priority from the prior Japanese Patent Application No. 2010-241790, filed Oct. 28, 2010, the entire contents of which is incorporated herein by reference.

BACKGROUND OF THE INVENTION

1. Field of the Invention

The present invention relates to an input apparatus suitable for use in, for example, an electronic percussion instrument, and a recording medium with a program recorded therein.

2. Description of the Related Art

An input apparatus is known that detects movement and thereby generates operation input. For example, Japanese Patent Application Laid-Open (Kokai) Publication No. 06-075571 discloses a stick (drumstick) provided with a piezoelectric gyro sensor that detects angular speed. When a user grips the stick and swings it downward or to the right, operation input is generated by which a snare drum sound or a cymbal sound is designated based on the downward component or the rightward component of sensor output (angular speed) from a sensor that has detected the movement, and its sound volume is designated based on the sensor output level.

However, in the technology disclosed in Japanese Patent Application Laid-Open (Kokai) Publication No. 06-075571, sensor output from the sensor that has detected the movement of the stick and the sensor output level are generated merely as operation input for designating a sound to be produced and the sound volume. Therefore, operation input for another operation mode, such as a setting change mode in which the setting of a parameter for designating the configuration of sound production are changed, cannot be generated according to a movement differing from a playing movement in which the stick is swung.

An object of the present invention is to provide an input apparatus capable of generating operation input for another operation mode through a movement differing from a playing movement.

SUMMARY OF THE INVENTION

In accordance with one aspect of the present invention, there is provided an input apparatus comprising: a first operation detecting section which is provided on a first operating section and detects acceleration and angular speed based on movement of the first operating section; a second operation detecting section which is provided on a second operating section and detects acceleration and angular speed based on movement of the second operating section; a judging section which judges whether or not the first operating section and the second operating section have been held together, based on the acceleration and the angular speed detected by the first operation detecting section and the acceleration and the angular speed detected by the second operation detecting section; a detecting section which detects a change operation based on the acceleration and the angular speed detected by the first operation detecting section and the acceleration and the angular speed detected by the second operation detecting section, when the judging section judges that the first operating section and the second operating section have been held together; and a changing section which changes a predetermined parameter in accordance with the change operation detected by the detecting section.

In accordance with another aspect of the present invention, there is provided a non-transitory computer-readable storage medium having stored thereon a program that is executable by a computer, the program being executable by the computer to perform functions comprising: first operation detection processing for detecting acceleration and angular speed based on movement of a first operating section; second operation detection processing for detecting acceleration and angular speed based on movement of a second operating section; judgment processing for judging whether or not the first operating section and the second operating section have been held together, based on the acceleration and the angular speed detected in the first operation detection processing and the acceleration and the angular speed detected in the second operation detection processing; detection processing for detecting a change operation based on the acceleration and the angular speed detected in the first operation detection processing and the acceleration and the angular speed detected in the second operation detection processing, when the first operating section and the second operating section are judged to have been held together in the judgment processing; and change processing for changing a predetermined parameter in accordance with the change operation detected in the detection processing.

The above and further objects and novel features of the present invention will more fully appear from the following detailed description when the same is read in conjunction with the accompanying drawings. It is to be expressly understood, however, that the drawings are for the purpose of illustration only and are not intended as a definition of the limits of the invention.

DETAILED DESCRIPTION OF THE PREFERRED EMBODIMENTS

The preferred embodiments of the present invention will hereinafter be described with reference to the drawings.

First Embodiment

A. Structure

Figure 1:
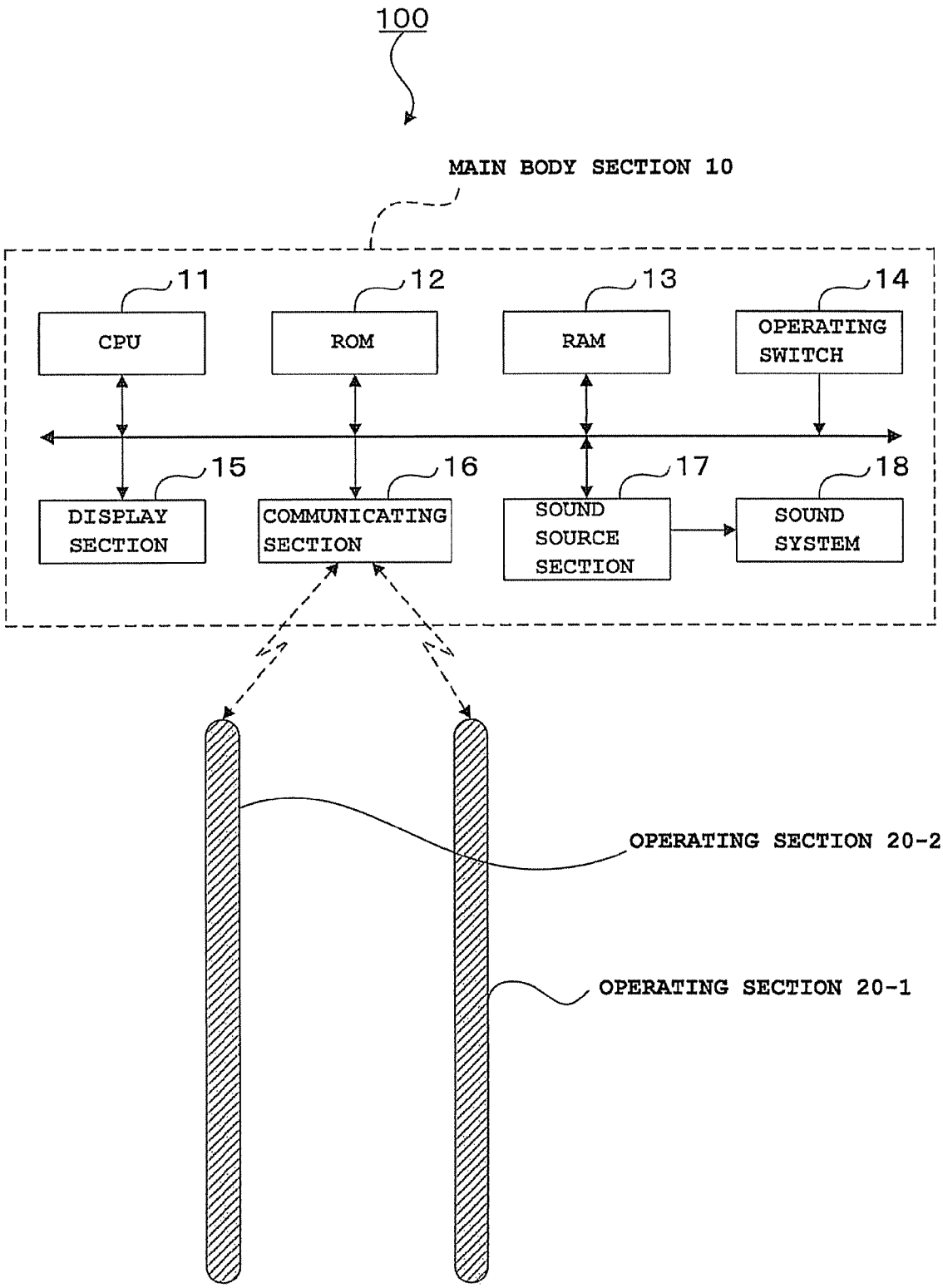
FIG. 1 is a block diagram showing the overall structure of an electronic percussion instrument 100 according to a first embodiment.

FIG. 1 is a block diagram showing the overall structure of an electronic percussion instrument 100 including an input apparatus according to a first embodiment. The electronic percussion instrument 100 is broadly divided into a main body section 10, and operating sections 20-1 and 20-2 (first operating section and second operating section) that are respectively gripped in the left and right hands of a user. The operating sections 20-1 and 20-2 are, for example, drumstick-shaped. The structure of the main body section 10 and the structure of the operating section 20 will hereinafter be described separately.

(1) Structure of Main Body Section 10

The main body section 10 includes a central processing unit (CPU) 11 (a judging section, a detecting section, a changing section, an orientation difference acquiring section, and a note-ON operation detecting section), a read-only memory (ROM) 12, a random access memory (RAM) 13, an operating switch 14, a display section 15, a communicating section 16, a sound source section 17 and a sound system 18. When a drum movement (playing movement) is performed in which the operating section 20 is swung, the CPU 11 gives an instruction to generate a percussion sound by performing main body processing (see FIG. 4) described hereafter. Conversely, when a movement differing from the playing movement is made, or in other words, when the operating sections 20-1 and 20-2 are held together and unified as in the example shown in FIG. 5, the CPU 11 provides the function of an input apparatus that generates operation input for another operation mode (a setting change mode described hereafter).

The ROM 12 stores various program data, control data, and the like which are loaded by the CPU 11. The various programs here include the main body processing (see FIG. 4) described hereafter. The RAM 13 includes a work area and a data area. The work area of the RAM 13 temporarily stores various register and flag data used for processing by the CPU 11, and the data area of the RAM 13 stores acceleration data and angular speed data of the operating sections 20-1 and 20-2 received and demodulated via the communicating section 16 described hereafter. Note that identification data, which identifies to which of the operating sections 20-1 and 20-2 acceleration data or angular speed data corresponds, is added to each acceleration data and angular speed data stored in the data area of the RAM 13.

The operating switch 14 includes a power switch for turning ON and OFF the power of the main body section 10, a play switch for giving an instruction to start or end a musical performance, and the like, and generates an event based on a switch operation. Events generated by the operating switch 14 are received by the CPU 11. The display section 15 displays the operation status or the setting status of the main body section 10 based on display control signals supplied by the CPU 11.

The communicating section 16 receives and demodulates acceleration data and angular speed data (including identification data) wirelessly transmitted from the operating sections 20-1 and 20-2 under the control of the CPU 11, and stores the received acceleration data in a predetermined area in the RAM 13. The sound source section 17 is configured by the known waveform memory read-out method and replays waveform data of a musical sound (a percussion instrument sound) whose tone has been designated by the user, in accordance with a note-ON event supplied by the CPU 11. The sound system 18 converts the waveform data of a percussion instrument sound outputted from the sound source section 17 to an analog signal format, and produces the sound from a speaker after removing unnecessary noise and amplifying the level.

(2) Structure of Operating Section 20

Figure 2:
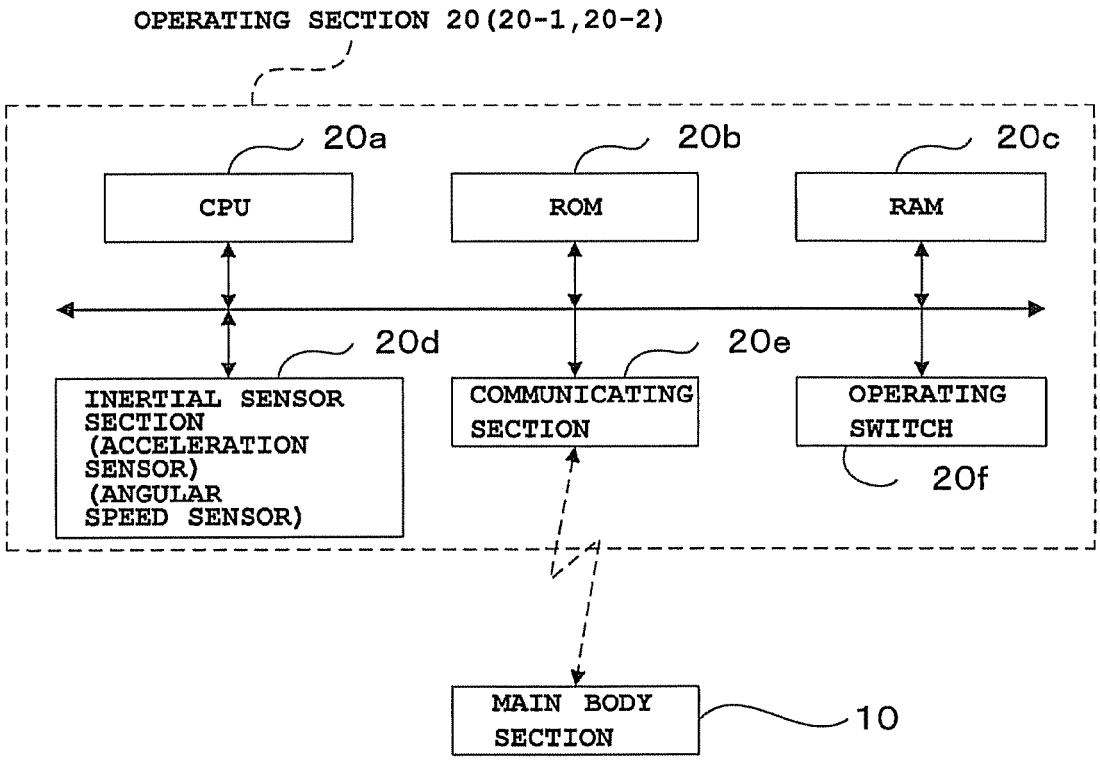
FIG. 2 is a block diagram showing the structure of an operating section 20 according to the first embodiment.

Next, the structures of the operating sections 20-1 and 20-2 will be described with reference to FIG. 2. As shown in FIG. 2, the operating sections 20-1 and 20-2 each includes therein components 20*a* to 20*f*. A CPU 20*a* performs operating section processing (see FIG. 3) described hereafter. In the operating section processing, when the play switch is turned ON, the CPU 20*a* stores in a RAM 20*c* acceleration data and angular speed data generated by sampling output from an inertial sensor section 20*d* (a first operation detecting section and a second operation detecting section), and after reading out the acceleration data and angular speed data stored in the RAM 20*c*, wirelessly transmits them from a communicating section 20*e* to the main body section 10 side.

The ROM 20*b* stores various program data, control data, and the like which are loaded by the CPU 20*a*. The various programs here include the operating section processing (see FIG. 3) described hereafter. The RAM 20*c* includes a work area and a data area. The work area of the RAM 20*c* temporarily stores various register and flag data used for processing by the CPU 20*a*, and the data area of the RAM 20*c* temporarily stores acceleration data and angular speed data outputted from the inertial sensor section 20*d*.

The inertial sensor section 20*d* is constituted by, for example, a capacitive-type acceleration sensor that detects acceleration of three orthogonal axis components, a piezoelectric gyro-type angular speed sensor that detects angular speed of three orthogonal axis components, and an analog-to-digital (A/D) converting section that performs A/D conversion on each output from the acceleration sensor and the angular speed sensor, and generates acceleration data and angular speed data. The communicating section 20*e* modulates acceleration data and angular speed data stored in the data area of the RAM 20*c* to data of a predetermined format, and wirelessly transmits them to the main body section 10 side. Note that identification data, which identifies by which of the operating sections 20-1 and 20-2 acceleration data or angular speed data has been generated, is added to acceleration data and angular speed data to be wirelessly transmitted. The operating switch 20*f* includes a power switch for turning ON and OFF the power, a play switch for giving an instruction to start or end a musical performance, and the like, and generates an event based on a switch operation. Events generated by the operating section 20*f* are received by the CPU 20*a*.

B. Operations

Next, operations of the electronic percussion instrument 100 structured as above will be described with reference to FIG. 3 to FIG. 8. In the descriptions below, the operation of the operating section processing performed by the CPU 20*a* on the operating section 20 side and the operation of the main body processing performed by the CPU 11 on the main body section 10 side will be described as the operations of the electronic percussion instrument 100.

(1) Operation of Operating Section Processing

Figure 3:
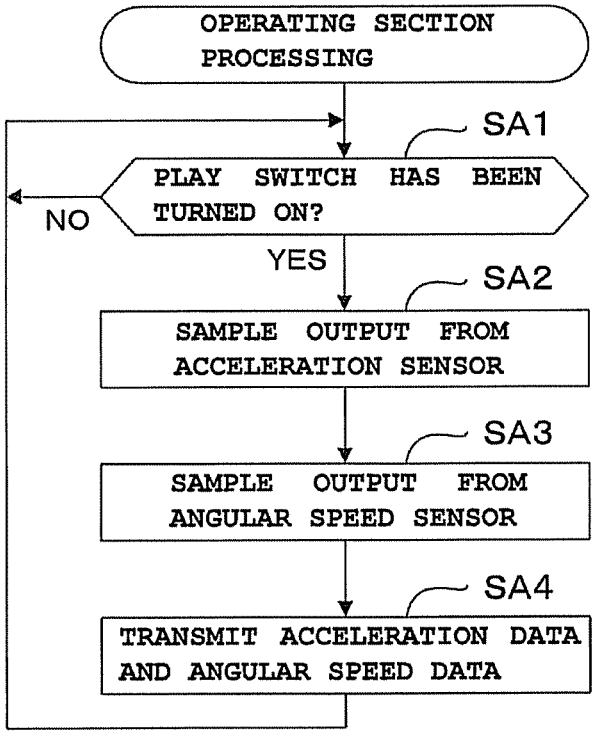
FIG. 3 is a flowchart showing the operation of operating section processing performed by the operating section 20 according to the first embodiment.

When the operating section 20 is turned ON by the operation of the power switch, the CPU 20*a* performs the operating section processing shown in FIG. 3 and proceeds to Step SA1. At Step SA1, the CPU 20*a* waits until the play switch is set in an ON state that indicates the start of a musical performance. When the user sets the play switch in the ON state, a judgment result at Step SA1 is "YES" and the CPU 20*a* proceeds to Step SA2. At Step SA2, the CPU 20*a* stores in the RAM 20*c* acceleration data acquired by performing A/D conversion on output from the acceleration sensor of the inertial sensor section 20*d*.

Next, at Step SA3, the CPU 20*a* stores in the RAM 20*c* angular speed data acquired by performing A/D conversion on output from the angular speed sensor of the inertial sensor section 20*d*. Next, at Step SA4, the CPU 20*a* adds identification data, which identifies by which operating sections 20-1 and 20-2 the acceleration data or the angular speed data have been generated, to the acceleration data and the angular speed data read out from the RAM 20*c*, and wirelessly transmits them to the main body section 10 side from the communicating section 20*e*. Hereafter, until the play switch is set in an OFF state that indicates the end of a musical performance, the CPU 20*a* repeats Step SA1 to Step SA4 described above, and generates and wirelessly transmits acceleration data and angular data that change depending on the operation of the operating section performed by the user.

(2) Operation of Main Body Processing

Figure 4:
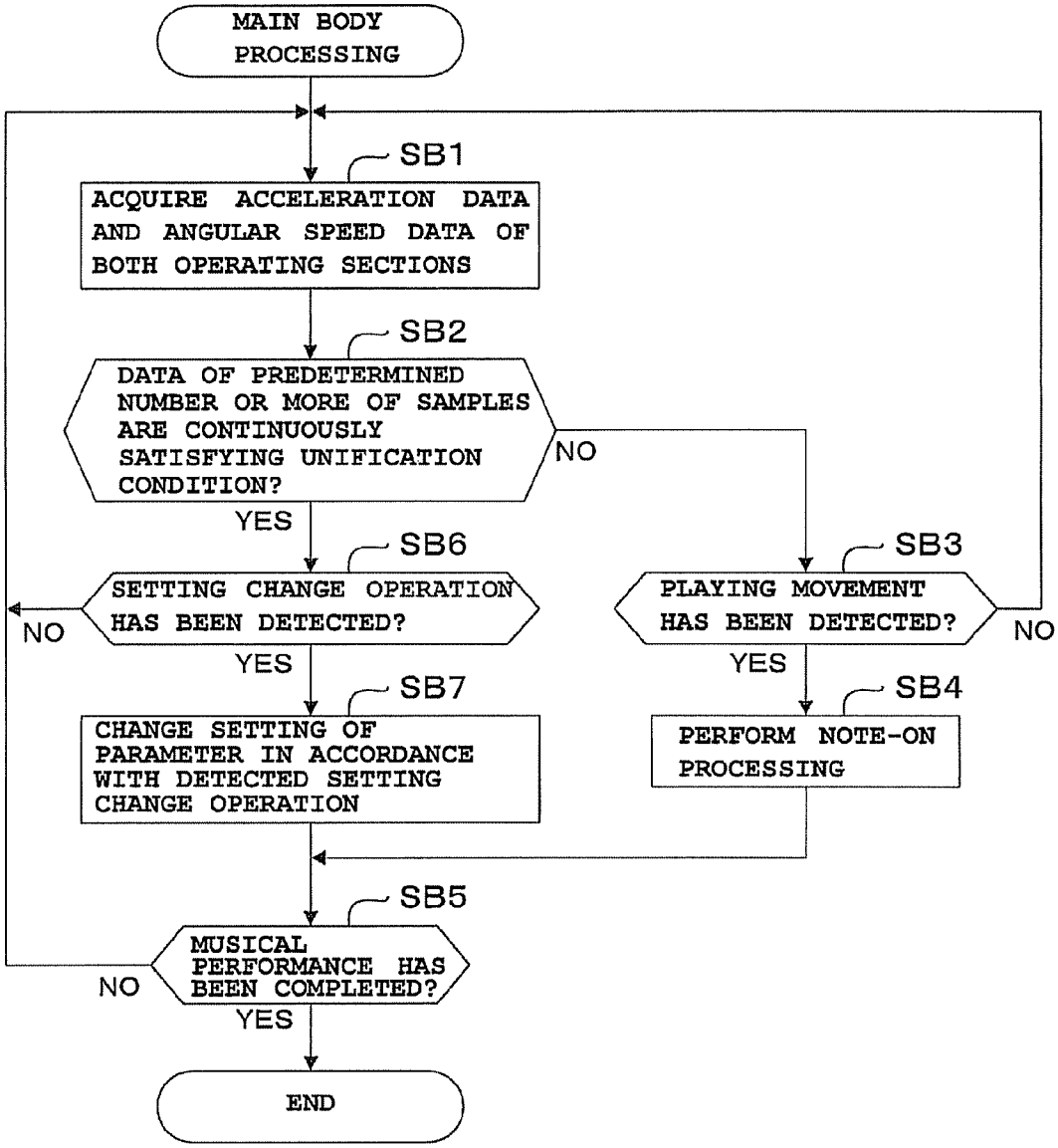
FIG. 4 is a flowchart showing the operation of main body processing performed by a main body section 10 according to the first embodiment.

When the main body section 10 is turned ON by the operation of the power switch, the CPU 11 performs the main body processing shown in FIG. 4 and proceeds to Step SB1. At Step SB1, the CPU 11 receives and demodulates acceleration data and angular speed data (including identification data) wirelessly transmitted from the operating section 20-1 and the operating section 20-2, and stores them in a predetermined area of the RAM 13.

Figure 5:
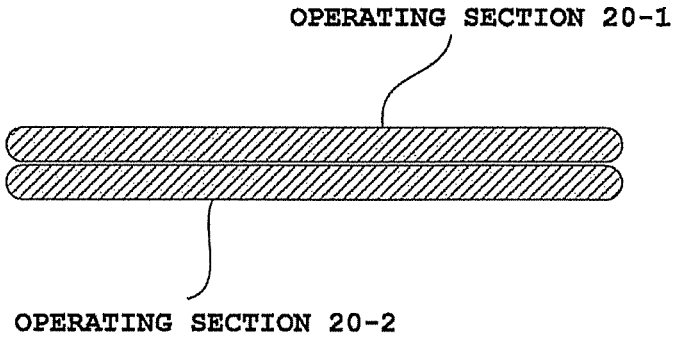
FIG. 5 is a diagram showing an example of unification of operating sections 20-1 and 20-2.

Next, at Step SB2, the CPU 11 judges whether or not the operating sections 20-1 and 20-2 have been held together and unified as shown in the example in FIG. 5, based on the acquired acceleration data and angular speed data. Specifically, the CPU 11 judges whether or not acceleration data and angular speed data of a predetermined number of previous samples including the current acceleration data and angular speed data are satisfying a unification condition continuously. The unification condition herein is constituted by the following judgment criteria a to f:

a. whether or not the accelerations of the operating sections 20-1 and 20-2 in their respective longitudinal directions are continuously in agreement (first judging section);

b. whether or not the magnitudes of combined biaxial accelerations other than in the longitudinal directions are continuously in agreement (second judging section);

c. whether or not temporal changes in the directions of the acceleration vectors of the combined biaxial accelerations other than in the longitudinal directions are continuously in agreement (third judging section);

d. whether or not the angular speeds of the rotations of the operating sections 20-1 and 20-2 centering on their respective longitudinal directions are continuously in agreement (fourth judging section);

e. whether or not the magnitudes of the combined angular speeds of rotations centering on two axes other than in the longitudinal directions are continuously in agreement (fifth judging section); and f. whether or not temporal changes in the directions of the angular speed vectors of the combined angular speeds of the rotations centering on the two axes other than in the longitudinal directions are continuously in agreement (sixth judging section).

When judged that the unification condition constituted by the above-described judgment criteria a to f is not being satisfied, or in other words, when judged that the user is gripping the operating sections 20-1 and 20-2 separately rather than holding them together, the judgment result at Step SB2 is "NO" and so the CPU 11 proceeds to Step SB3. At Step SB3, the CPU 11 judges whether or not the user is making a playing movement in which the user swings the operating sections 20-1 and 20-2 gripped in each hand to beat a drum or the like, based on the acceleration data generated by the operating sections 20-1 and 20-2. When judged that the user is not making the playing movement, the judgment result is "NO", and so the CPU 11 returns to Step SB1.

Conversely, when judged that the user is making the playing movement in which the user swings the operating sections 20-1 and 20-2 gripped in each hand to beat a drum or the like, the judgment result at Step SB3 is "YES", and so the CPU 11 proceeds to Step SB4. At Step SB4, the CPU 11 performs note-ON processing for giving an instruction to produce a sound based on the acquired acceleration data.

In the note-ON processing, the CPU 11 judges whether or not a polarity change from positive to negative has occurred between the polarity of acceleration data acquired the last time and the polarity of the acceleration data acquired this time, or in other words, whether or not a note-ON operation has been performed in which the operating section 20 is swung upwards after being swung downwards. When judged that the note-ON operation has been performed, the CPU 11 generates a note-ON event and supplies it to the sound source section 17. Then, the CPU 11 proceeds to Step SB5 and judges whether or not an instruction to end the musical performance has been given by the operation of the play switch. When judged that an instruction to end the musical performance has not been given, the judgment result is "NO", and so the CPU 11 returns to the processing at Step SB1.

Conversely, when judged at Step SB2 that the operating sections 20-1 and 20-2 are in the state of being held together and unified, the unification condition constituted by the judgment criteria a to f is satisfied. Accordingly, the judgment result at Step SB2 is "YES", and so the CPU 11 proceeds to Step SB6. At Step SB6, the CPU 11 judges whether or not a setting change operation corresponding to any one of plural types of predetermined setting change operations has been detected, based on the acceleration data and angular speed data generated by the operating sections 20-1 and 20-2 which have been held together and unified.

Specifically, an operation to move the operating sections 20-1 and 20-2 which have been held together and unified in the up/down direction, the left/right direction, or the front/back direction, an operation to move the operating sections 20-1 and 20-2 so as to draw a circle, a triangle, or a square, or the like are set in advance as the setting change operations, and the CPU 11 detects whether or not a corresponding setting change operation has been performed from the acceleration data and angular speed data generated by the operating sections 20-1 and 20-2. When a corresponding setting change operation is not detected, the judgment result at Step SB6 is "NO", and so the CPU 11 returns to the processing at Step SB1. Conversely, when a corresponding setting change operation is detected, the judgment result at Step SB6 is "YES", and so the CPU 11 proceeds to Step SB7.

At Step SB7, the CPU 11 changes the setting of a parameter related to content associated with the detected setting change operation. For example, a case is described in which an operation to move the operating sections 20-1 and 20-2 which have been held together and unified so as to draw a circle is set as a setting change operation, and content indicating that a tone number is to be incremented is associated with this setting change operation. In this case, when an operation to move the operating sections 20-1 and 20-2 which have been held together and unified so as to draw a circle is performed, a tone number designating the tone of a generated musical sound (percussion instrument sound) is incremented, whereby the setting change of the tone parameter is performed. When the setting change of the parameter in accordance with the setting change operation is completed as just described, the CPU 11 proceeds to Step SB5. Then, when judged at Step SB5 that an instruction to end the musical performance has been given, the judgment result is "YES", and so the CPU 11 completes the main body processing.

As described above, in the first embodiment, each operating section 20-1 and 20-2 individually generates and wirelessly transmits acceleration data and angular speed data that change depending on the operation by the user, and the main body section 10 side receives them. Then, the main body section 10 judges whether or not acceleration data and angular speed data of a predetermined number of previous samples including the current acceleration data and angular speed data are satisfying the unification condition continuously, or in other words, whether or not the operating sections 20-1 and 20-2 are in the state of being held together and unified. When judged that the operating sections 20-1 and 20-2 are in the state of being held together and unified, the main body section 10 judges whether or not a setting change operation corresponding to any one of plural types of predetermined setting change operations has been detected, based on the acceleration data and angular speed data generated by the operating sections 20-1 and 20-2 which have been held together and unified. Then, when a setting change operation is detected, the main body section 10 performs the setting change of a parameter in accordance with the detected setting change operation. Therefore, operation input for another operation mode can be generated by a movement differing from a playing movement.

In the above-described first embodiment, the orientations of the operating sections 20-1 and 20-2 when they are held together and unified are not taken into consideration. However, a configuration may be adopted in which judgment is made regarding whether or not the operating sections 20-1 and 20-2 are facing opposite directions to each other and being held together to be unified. In this instance, the integration condition judged at above-described Step SB2 is constituted by the following judgment criteria g to l:

g. whether or not acceleration of one operating section 20 in the longitudinal direction is continuously in agreement with acceleration of the other operating section 20 in the longitudinal direction which has been multiplied by "−1" (seventh judging section);

h. whether or not the magnitudes of combined biaxial accelerations other than in the longitudinal directions are continuously in agreement (eighth judging section);

i. whether or not a temporal change in the direction of the acceleration vector of the combined biaxial acceleration of the one operating section 20 other than in the longitudinal direction is continuously in agreement with a temporal change in the direction of the acceleration vector of the combined biaxial acceleration of the other operating section 20 other than in the longitudinal direction which has been multiplied by "−1" (ninth judging section);

j. whether or not the angular speed of the rotation of the one operating section 20 centering on the longitudinal direction is continuously in agreement with the angular speed of the rotation of the other operating section 20 centering on the longitudinal direction which has been multiplied by "−1" (tenth judging section);

k. whether or not the magnitudes of the combined angular speeds of rotations centering on two axes other than in the longitudinal directions are continuously in agreement (eleventh judging section); and l. whether or not a temporal change in the direction of the acceleration vector of the combined angular speed of the rotations of the one operating section 20 centering on the two axes other than in the longitudinal direction is continuously in agreement with a temporal change in the direction of the acceleration vector of the combined angular speed of the rotations of the other operating section 20 centering on the two axes other than in the longitudinal direction which has been multiplied by "−1" (twelfth judging section).

When judged that the unification condition constituted by the judgment criteria g to l is being satisfied, and the operating sections 20-1 and 20-2 are facing opposite directions to each other and being held together to be unified, the main body section 10 judges whether or not a setting change operation corresponding to any one of plural types of predetermined setting change operations has been detected, based on the acceleration data and angular speed data generated by the operating sections 20-1 and 20-2. Then, when a setting change operation is detected, the main body section 10 performs the setting change of a parameter in accordance with the detected setting change operation. Therefore, operation input for another operation mode can be generated by a movement differing from a playing movement.

Moreover, in the above-described first embodiment, if the acceleration sensors in the operating sections 20-1 and 20-2 are in areas apart from each other when the operating sections 20-1 and 20-2 are held together, centrifugal force is applied differently to each acceleration sensor as a result of a rotation component in the movement of the operating sections 20-1 and 20-2 that are being held together. Accordingly, accelerations measured for the operating sections 20-1 and 20-2 may not be in agreement even when the operating sections 20-1 and 20-2 are being held together. Therefore, the acceleration sensors may be provided in the centers of the operating sections so that they come close to each other regardless of whether the operating sections are held together to face the same direction or held together to face opposite directions to each other. In addition, a configuration may be adopted in which the user is warned to ensure that the acceleration sensors set in the operating sections do not separate when holding the operating sections 20 together.

Furthermore, as a measure to ensure that the acceleration sensors do not separate when the operating sections are held together, a structure may be adopted in which a permanent magnet of an appropriate magnetic force and a ferromagnetic metal are provided near both ends of each operating section, respectively. As a result, regardless of whether the user holds the operating sections to face the same direction or holds them to face opposite directions to each other, the permanent magnet provided in the end section of one operating section magnetically bonds to the ferromagnetic metal provided in the end section of the other operating section.

Still further, whether or not the operating sections are in the state of being unified may be judged as follows. First, when the proximity between the acceleration sensors while the operating sections are being held together cannot be ensured, examination based on the judgment criteria d to f is performed from among the above-described judgment criteria a to f constituting the unification condition. Then, (i) when the angular speed is relatively high, and the judgment criteria a to c are not satisfied as a result of centrifugal force, examination based on the judgment criteria a to c is omitted. Conversely, (ii) when the angular speed is relatively low, examination based on the judgment criteria a to c is performed, and whether or not the operating sections are in the state of being held together and unified is judged. Note that, in unification judgment such as this, judgment accuracy inevitably decreases compared to when all judgment criteria a to f are examined.

Yet still further, in the above-described first embodiment, the inertial sensor **20*d*** including the acceleration sensor and the angular speed sensor is used. However, the present invention is not limited thereto, and either of the acceleration sensor and the angular speed sensor may be excluded. In addition, a three-axis magnetic sensor may be included therein to judge whether or not the operating sections are in the state of being held together and unified.

Second Embodiment

Next, the operation of main body processing according to a second embodiment will be described with reference to FIG. 6 to FIG. 8. In the second embodiment, the operating sections 20-1 and 20-1 in the first embodiment are replaced by a cuboid-shaped housing 1 and housing 2 such as those shown in FIG. 7. As in the case of the operating sections 20-1 and 20-2 of the first embodiment, each housing 1 and 2 wirelessly transmits acceleration data and angular speed data.

Figure 6:
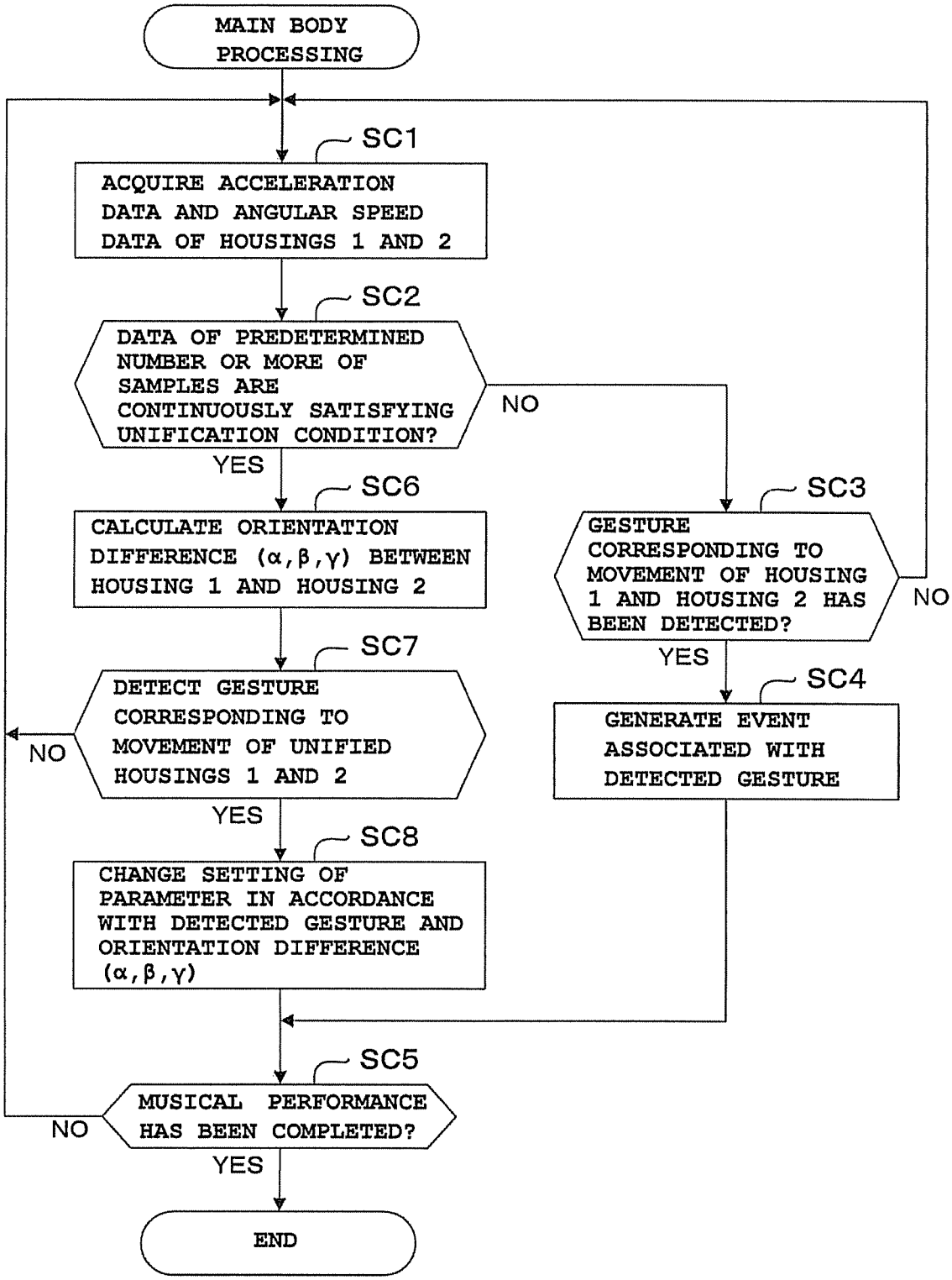
FIG. 6 is a flowchart showing the operation of main body processing according to a second embodiment.

As in the case of the first embodiment, when the main body section 10 is turned ON by the operation of the power switch, the CPU 11 performs the main body processing shown in FIG. 6 and proceeds to Step SC1. At Step SC1, the CPU 11 receives and demodulates acceleration data and angular speed data (including identification data) respectively wirelessly transmitted from the housing 1 and the housing 2, and stores them in a predetermined area of the RAM 13.

Next, at Step SC2, the CPU 11 judges whether or not the housing 1 and the housing 2 are in contact with each other in the state of being unified, based on the acquired acceleration data and angular speed data. Specifically, the CPU 11 judges whether or not acceleration data and angular speed data of a predetermined number of previous samples including the current acceleration data and angular speed data are satisfying a unification condition continuously. The unification condition herein is constituted by the following judgment criteria m to p:

m. whether or not the magnitudes of the combining acceleration vectors of the combined triaxial accelerations of the housings 1 and 2 are continuously in agreement (thirteenth judging section);

n. whether or not temporal changes in the directions of the combining acceleration vectors are continuously in agreement (fourteenth judging section);

o. whether or not the magnitudes of the combining angular speed vectors of the combined triaxial angular speeds of the housings 1 and 2 are continuously in agreement (fifteenth judging section); and p. whether or not temporal changes in the directions of the combining angular speed vectors are continuously in agreement (sixteenth judging section).

When judged that the unification condition constituted by the above-described judgment criteria m to p is not being satisfied, or in other words, when judged that the housing 1 and the housing 2 are not in contact with each other and being moved separately, the judgment result at Step SC2 is "NO", and so the CPU 11 proceeds to Step SC3. At Step SC3, the CPU 11 judges whether or not a gesture corresponding to any one of plural types of predetermined gestures has been detected, based on the acceleration data and angular speed data generated by the housing 1 and the housing 2 according to a movement by the user. When a corresponding gesture is not detected, the judgment result is "NO", and so the CPU 11 returns to the processing at Step SC1. The gesture herein refers to the movement of the user gripping the housings 1 and 2.

Conversely, when a corresponding gesture is detected based on the acceleration data and angular speed data generated by the housing 1 and the housing 2 according to the movement by the user, the judgment result at Step SC3 is "YES". Accordingly, the CPU 11 proceeds to Step SC4 and generates an event associated with the detected gesture. For example, when the generated event is the change of control, the CPU 11 instructs the sound source section 17 to control sound volume. Then, the CPU 11 proceeds to Step SC5 and judges whether or not an instruction to end the musical performance has been given by the operation of the play switch. When judged that an instruction to end the musical performance has not been given, the judgment result is "NO", and so the CPU 11 returns to the processing at Step SC1.

At Step SC2, when judged that the unification condition constituted by the judgment criteria m to p is being satisfied and the housing 1 and the housing 2 are in contact with each other in the state of being unified, the judgment result at Step SC2 is "YES". Accordingly, the CPU 11 proceeds to Step SC6, and calculates the orientation difference between the housing 1 and the housing 2 as Euler angles ($\alpha,\beta,\gamma$). The orientation difference between the housing 1 and the housing 2 is selected from acceleration vectors or angular speed vectors that are not parallel with each other, based on the acceleration data and angular speed data acquired when the unification conditions is satisfied.

To improve the calculation accuracy, ordinarily, acceleration vectors or angular speed vectors are preferably selected that have a relatively large magnitude and have a relationship in which the vectors are as perpendicular to each other as possible. As long as this condition is satisfied, a vector V0 related to the housing 1 and a vector V1 related to the housing 2 may be any one of two acceleration vectors of different times, two angular speed vectors of different times, an acceleration vector and an angular speed vector of different times, and an acceleration vector and an angular speed vector of the same time.

Figure 7:
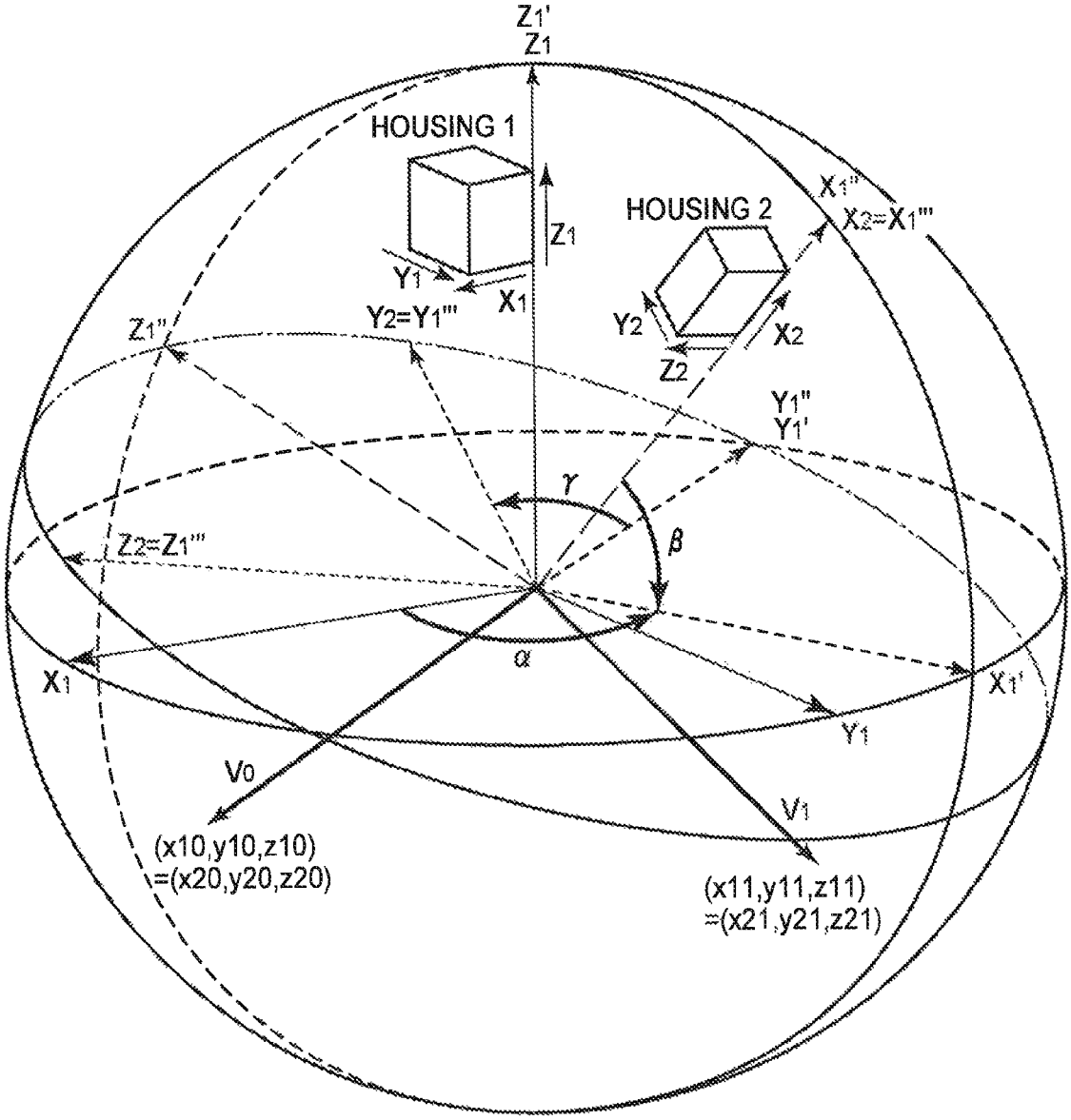
FIG. 7 is a diagram showing orientation differences expressed in Euler angles.
Figure 8:
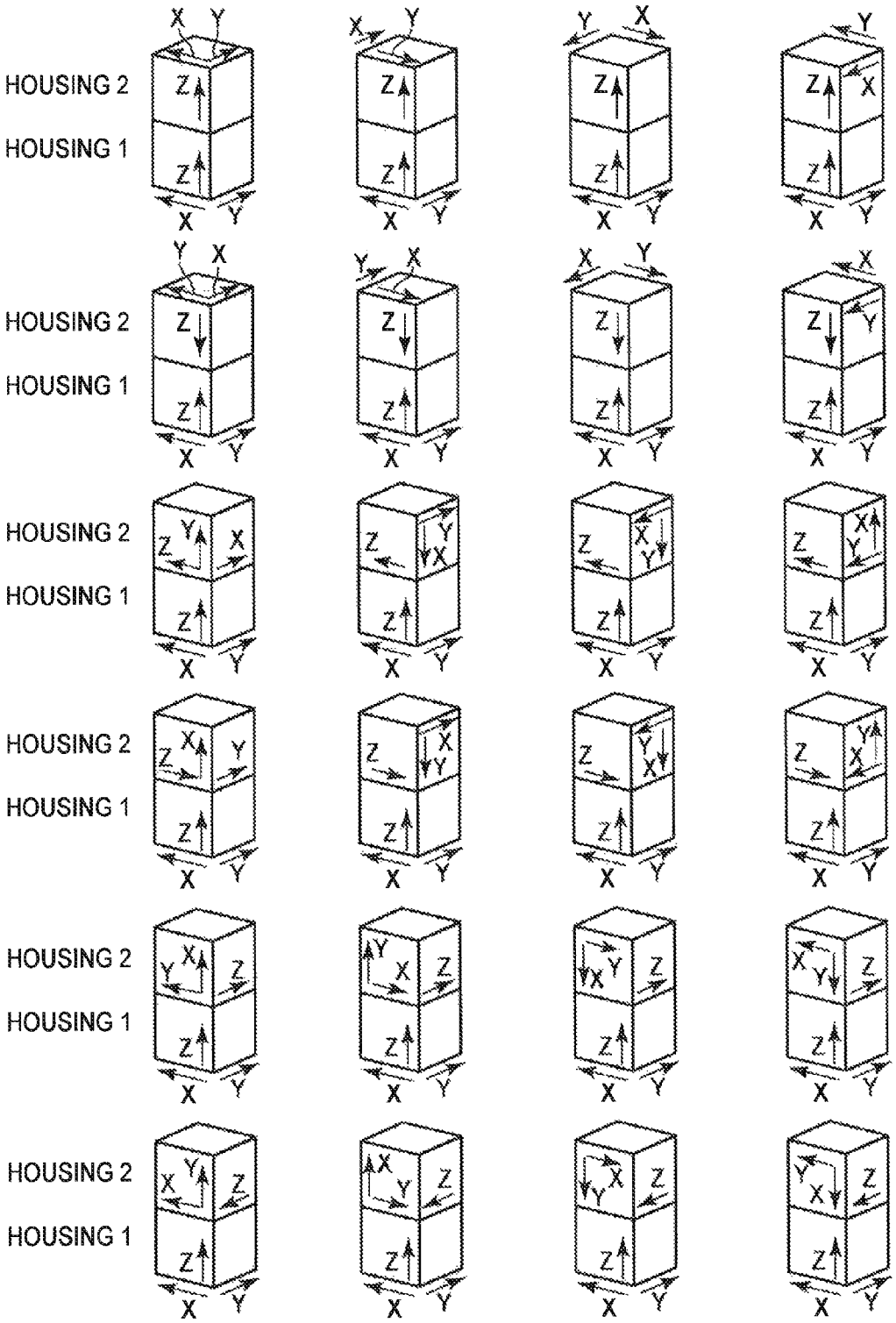
FIG. 8 is a diagram showing 24 variations of the orientation difference (left-hand system) of unified housings 1 and 2.

As in the example shown in FIG. 7, when the vector V0 related to the housing 1 and the vector V1 related to the housing 2 that are as perpendicular to each other as possible are selected, the difference between the coordinate system of the housing 1 and the coordinate system of the housing 2 is calculated as Euler angles ($\alpha,\beta,\gamma$) in the z-y-x coordinate system.

In FIG. 7, (X1,Y1,Z1) indicates the coordinate system of the housing 1; (X2,Y2,Z2) indicates the coordinate system of the housing 2; (x10,y10,z10) indicates the vector V0 coordinates in the coordinate system, of the housing 1; (x20,y20, z20) indicates the vector V0 coordinates in the coordinate system of the housing 2; (x11,y11,z11) indicates the vector V1 coordinates in the coordinate system of the housing 1; and (x21,y21,z21) indicates the vector V1 coordinates in the coordinate system of the housing 2. In addition, (X1',Y1',Z1') indicates a coordinate system that is the coordinate system (X1,Y1,Z1) of the housing 1 rotated by an angle $\alpha$ around the Z1 axis; (X1",Y1",Z1") indicates a coordinate system that is the coordinate system (X1',Y1',Z1') rotated by an angle $\beta$ around the Y1' axis; and (X1'",Y1'",Z1'") indicates a coordinate system that is the coordinate system (X1',Y1",Z1") rotated by an angle $\gamma$ around the X1" axis.

Next, the CPU 11 proceeds to Step SC7 and judges whether or not a gesture corresponding to any one of plural types of predetermined gestures has been detected, based on the acceleration data and angular speed data generated by the unified housing 1 and housing 2 according to a movement by the user. When a corresponding gesture is detected, the judgment result is "NO", and so the CPU 11 returns to the processing at Step SC1. When a corresponding gesture is detected, the judgment result is "YES", and so the CPU 11 proceeds to Step SC8.

Then, at Step SC8, the CPU 11 performs the setting change of a parameter based on the detected gesture and the Euler angles (α,β,γ) indicating the orientation difference between the housing 1 and the housing 2 calculated at Step SC6. Specifically, the CPU 11 selects a parameter associated with the detected gesture from among plural types of parameters that can be subjected to setting change, and changes the selected parameter based on the Euler angles (α,β,γ).

As a result of this configuration, even when gestures of moving the unified housings 1 and 2 are the same, various different setting change aspects can be achieved based on Euler angles (α,β,γ) indicating an orientation difference between the housing 1 and the housing 2. Next, when the setting change of a parameter based on the detected gesture and the orientation difference (α,β,γ) between the housing 1 and the housing 2 is completed as just described, the CPU 11 proceeds to Step SC5. At Step SC5, when judged that an instruction to end the musical performance has been given by the operation of the play switch, the judgment result is "YES", and so the CPU 11 completes the main body processing.

As described above, in the second embodiment, the housings 1 and 2 individually generates and wirelessly transmits acceleration data and angular speed data that change depending on the movement of the user, and the main body section 10 side receives them. Then, the main body section 10 judges whether or not acceleration data and angular speed data of a predetermined number of previous samples including the current acceleration data and angular speed data are satisfying the unification condition continuously. When judged that the housing 1 and the housing 2 are in the state of being unified, the main body section 10 calculates Euler angles (α,β,γ) indicating the orientation difference between the housing 1 and the housing 2.

Subsequently, the main body section 10 judges whether or not a gesture corresponding to any one of plural types of predetermined gestures has been detected, based on the acceleration data and angular speed data generated by the housing 1 and the housing 2. Then, when a corresponding gesture is detected, the main body section 10 performs the setting change of a parameter based on the detected gesture and the orientation difference (α,β,γ) between the housing 1 and the housing 2. As a result of this configuration, operation input for another operation mode, which changes based on a gesture of moving the unified housing 1 and housing 2 and an orientation difference (α,β,γ) between the housing 1 and the housing 2, can be generated by a movement (user's movement of unifying the housing 1 and the housing 2) differing from a playing movement.

In the above-described second embodiment, a parameter associated with a detected gesture changes based on an orientation difference (α,β,γ) between the housing 1 and the housing 2. However, the following configuration may be adopted instead. When the orientation difference (α,β,γ) is divided into 90 degree angles, 24 variations of orientation difference combinations are acquired as shown in FIG. 8. When a single combination thereof is considered as a single mode, the orientation difference (α,β,γ) has 24 different modes. In this configuration, a gesture to be recognized and a processing operation to be performed thereby (content of a parameter setting change) are registered in advance for each of the 24 different modes, and a processing operation to be performed (content of a parameter setting change) is determined based on a detected gesture, and an orientation difference (α,β,γ) between the housing 1 and the housing 2.

In a case where an intermediate orientation difference (α,β,γ) other than the above-described 24 different orientation differences is obtained as the calculated orientation difference, the closest combination may be automatically selected. In addition, the gestures registered for each mode are not required to be the same, and discrepancies may be present in the gestures to be detected for each mode. In this instance, because the mode is determined at above-described Step SC6 (see FIG. 6), the configuration may be such that only a gesture registered for the determined mode is detected at subsequent Step SC7, and detection operations for gestures not registered in the determined mode are not performed. Not all of the orientation differences divided into 90 degree angles are required to be used, and only some may be used. Alternatively, the orientation differences may be divided into smaller degree angles such as 45 degree angles. Moreover, various orientation differences may be set according to the shape of the housing.

Furthermore, in the above-described second embodiment, the orientation difference between the housing 1 and the housing 2 is defined as Euler angles (α,β,γ) in the z-y-x coordinate system. However, this is not limited thereto. For example, Euler angles in other coordinate systems, functions capable of expressing rotation such as quaternion, and parameters thereof can also be used.

While the present invention has been described with reference to the preferred embodiments, it is intended that the invention be not limited by any of the details of the description therein but includes all the embodiments which fall within the scope of the appended claims.

What is claimed is:

1. An input apparatus comprising:

a first operation detecting section which is provided on a first operating section and detects acceleration and angular speed based on movement of the first operating section;

a second operation detecting section which is provided on a second operating section and detects acceleration and angular speed based on movement of the second operating section;

a judging section which judges whether or not the first operating section and the second operating section have been held together, based on the acceleration and the angular speed detected by the first operation detecting section and the acceleration and the angular speed detected by the second operation detecting section;

a detecting section which detects a change operation based on the acceleration and the angular speed detected by the first operation detecting section and the acceleration and the angular speed detected by the second operation detecting section, when the judging section judges that the first operating section and the second operating section have been held together; and a changing section which changes a parameter for designating the configuration of sound production in accordance with the change operation detected by the detecting section.

2. The input apparatus according to claim 1, wherein the first operating section and the second operating section are stick-shaped; and the judging section includes:

a first judging section which judges whether or not accelerations of the first operating section and the second operating section in longitudinal directions are continuously in agreement;

a second judging section which judges whether or not magnitudes of combined biaxial accelerations of the first operating section and the second operating section other than in the longitudinal directions are continuously in agreement;

a third judging section which judges whether or not whether or not temporal changes in directions of acceleration vectors of the combined biaxial accelerations of the first operating section and the second operating section other than in the longitudinal directions are continuously in agreement;

a fourth judging section which judges whether or not angular speeds of rotations of the first operating section and the second operating section centering on the longitudinal directions are continuously in agreement;

a fifth judging section which judges whether or not magnitudes of combined angular speeds of rotations of the first operating section and the second operating section centering on two axes other than in the longitudinal directions are continuously in agreement; and a sixth judging section which judges whether or not temporal changes in directions of angular speed vectors of the combined angular speeds of the rotations of the first operating section and the second operating section centering on the two axes other than in the longitudinal directions are continuously in agreement.

3. The input apparatus according to claim 1, wherein the judging section judges whether or not the first operating section and the second operating section have been held together to face opposite directions to each other.

4. The input apparatus according to claim 3, wherein the first operating section and the second operating section are stick-shaped; and the judging section includes:

a seventh judging section which judges whether or not an acceleration of the first operating section in a longitudinal direction is continuously in agreement with an acceleration of the second operating section in a longitudinal direction which has been multiplied by "−1";

a eighth judging section which judges whether or not a magnitude of a combined biaxial acceleration of the first operating section other than in the longitudinal direction is continuously in agreement with a magnitude of a combined biaxial acceleration of the second operating section other than in the longitudinal direction;

a ninth judging section which judges whether or not a temporal change in a direction of an acceleration vector of the combined biaxial acceleration of the first operating section other than in the longitudinal direction is continuously in agreement with a temporal change in a direction of an acceleration vector of the combined biaxial acceleration of the second operating section other than in the longitudinal direction which has been multiplied by "−1";

a tenth judging section which judges whether or not an angular speed of a rotation of the first operating section centering on the longitudinal direction is continuously in agreement with an angular speed of a rotation of the second operating section centering on the longitudinal direction which has been multiplied by "−1";

an eleventh judging section which judges whether or not a magnitude of a combined angular speed of rotations of the first operating section centering on two axes other than in the longitudinal direction is continuously in agreement with a magnitude of a combined angular speed of rotations of the second operating section centering on two axes other than in the longitudinal direction; and a twelfth judging section which judges whether or not a temporal change in a direction of an acceleration vector of the combined angular speed of the rotations of the first operating section centering on the two axes other than in the longitudinal direction is continuously in agreement with a temporal change in a direction of an acceleration vector of the combined angular speed of the rotations of the second operating section centering on the two axes other than in the longitudinal direction which has been multiplied by "−1".

5. The input apparatus according to claim 1, further comprising:

an orientation difference acquiring section which acquires an orientation difference between the first operating section and the second operating section, when the judging section judges that the first operating section and the second operating section have been held together;

wherein the changing section changes a parameter for designating the configuration of sound production in accordance with the change operation detected by the detecting section and the orientation difference acquired by the orientation difference acquiring section.

6. The input apparatus according to claim 5, wherein the judging section includes:

a thirteenth judging section which judges whether or not magnitudes of combining acceleration vectors of combined triaxial accelerations of the first operating section and the second operating section are continuously in agreement;

a fourteenth judging section which judges whether or not temporal changes in directions of the combining acceleration vectors of the combined triaxial accelerations of the first operating section and the second operating section are continuously in agreement;

a fifteenth judging section which judges whether or not magnitudes of combining angular speed vectors of combined triaxial angular speeds of the first operating section and the second operating section are continuously in agreement; and a sixteenth judging section which judges whether or not temporal changes in directions of the combining angular speed vectors of the combined triaxial angular speeds of the first operating section and the second operating section are continuously in agreement.

7. The input apparatus according to claim 1, wherein the first operating section and the second operating section are cuboid-shaped housings.

8. The input apparatus according to claim 1, further comprising:

a note-ON operation detecting section which detects a note-ON operation based on the acceleration detected by the first operation detecting section or the second operation detecting section, when the judging section judges that the first operating section and the second operating section have not been held together.

9. A non-transitory computer-readable storage medium having stored thereon a program that is executable by a computer, the program being executable by the computer to perform functions comprising:

first operation detection processing for detecting acceleration and angular speed based on movement of a first operating section;

second operation detection processing for detecting acceleration and angular speed based on movement of a second operating section;

judgment processing for judging whether or not the first operating section and the second operating section have been held together, based on the acceleration and the angular speed detected in the first operation detection processing and the acceleration and the angular speed detected in the second operation detection processing;

detection processing for detecting a change operation based on the acceleration and the angular speed detected in the first operation detection processing and the acceleration and the angular speed detected in the second operation detection processing, when the first operating section and the second operating section are judged to have been held together in the judgment processing; and change processing for changing a parameter for designating the configuration of sound production in accordance with the change operation detected in the detection processing.

* * * * *